US007604407B2

(12) United States Patent
Bois

(10) Patent No.: US 7,604,407 B2
(45) Date of Patent: Oct. 20, 2009

(54) CLOSURE STRIPS FOR A SHEET OR A BAG, AND A RESULTING SHEET OR A BAG

(75) Inventor: Henri Bois, Neuilly sur seine (FR)

(73) Assignee: S2F Flexico, Henonville (FR)

( * ) Notice: Subject to any disclaimer, the term of this patent is extended or adjusted under 35 U.S.C. 154(b) by 85 days.

(21) Appl. No.: 11/413,351

(22) Filed: Apr. 28, 2006

(65) Prior Publication Data

US 2006/0282997 A1 Dec. 21, 2006

(30) Foreign Application Priority Data

Jun. 17, 2005 (FR) ..... 05 06151

(51) Int. Cl.
*B65D 33/16* (2006.01)
*A44B 19/16* (2006.01)

(52) U.S. Cl. ..... 383/63; 24/399; 24/400; 383/64; 383/61.2

(58) Field of Classification Search ..... None
See application file for complete search history.

(56) References Cited

U.S. PATENT DOCUMENTS

| | | | | |
|---|---|---|---|---|
| 4,246,288 | A | 1/1981 | Sanborn, Jr. | |
| 4,655,862 | A | 4/1987 | Christoff et al. | |
| 5,063,639 | A | 11/1991 | Boeckmann et al. | |
| 5,722,128 | A * | 3/1998 | Toney et al. | 24/400 |
| 2003/0194154 | A1 | 10/2003 | Machacek et al. | |
| 2006/0171610 | A1 * | 8/2006 | Buchman et al. | 383/64 |

* cited by examiner

*Primary Examiner*—Jack W. Lavinder
(74) *Attorney, Agent, or Firm*—Blakely, Sokoloff, Taylor & Zafman LLP

(57) ABSTRACT

The present invention relates to a fastener or closure assembly for fitting to a sheet or to the mouth of a packaging bag, and comprising at least one fastener or closure strip formed by a support web and a fastener or closure element carried by the web, the assembly including sequential cuts occupying a fraction of the width of the support web of the strip, outside the fastener or closure element and distributed over the length of the assembly in order to suppress the effects of warping, curving, or curling of the assembly.

42 Claims, 2 Drawing Sheets

CLOSURE STRIPS FOR A SHEET OR A BAG, AND A RESULTING SHEET OR A BAG

The present invention relates to the field of sheets or bags fitted with fastener or closure assemblies.

BACKGROUND OF THE INVENTION

Numerous bags or sachets are known, for example but not exclusively for household use, that are fitted with assemblies at their mouths for making it possible at will to open them and close them several times in succession.

Such closure assemblies are known in particular that comprise two support webs carrying respective complementary male/female elements facing each other at the mouth of the bag. Functionally equivalent closure assemblies are also known that comprise hooks on the webs for being positioned facing one another at the mouth of the bag for fastening together by hooking onto one another.

In other fields, in particular in the fields of providing displays or wrapping, sheets are also known that are fitted with fastener assemblies designed to cooperate with complementary fastener assemblies or means provided on another sheet or on an associated support.

The applicant has found that under certain circumstances prior fastener or closure assemblies do not give complete satisfaction.

This applies in particular to fastener or closure assemblies made out of polyolefins, mainly polyethylene or polypropylene. After being extruded, and prior to being secured to films for making up sheets or bags, such assemblies are generally wound on circular reels for storage purposes. Unfortunately, the polymers used for this purpose have elastic memory of their conditions of transformation, and over time they recrystallize, passing through various phases and in the form of different types of crystallite.

This leads to high levels of internal tension causing the assemblies that are stored in this way on circular reels to be subjected to a kind of warping or curling.

Such curvature can be very troublesome when implementing the process of securing fastener or closure assemblies on the film that is to constitute sheets or a bag. It will really be understood that because of this warping or curling of the assemblies, it is very difficult to ensure that such fastener or closure assemblies are accurately rectilinear after being unwound from storage on a reel. As a result, in use, it can sometimes be difficult to put such complementary fastener or closure assemblies in position, and consequently it can be difficult to obtain proper closure of bags or satisfactory assembly of sheets. Furthermore, it is often necessary to guide the assemblies so as to bring them onto the film that is to make up the bags or the sheets prior to securing them thereto, in particular when the fastener or closure assemblies are conveyed in a direction that extends across the travel direction of the film. It can turn out that if the fastener or closure assemblies are badly warped, then they can escape from the guides.

Various solutions have already been proposed consisting in particular in applying twisting to such closure assemblies in the direction opposite to that which was applied during storage, so as to eliminate the memory effect. Reference on this point can be made in particular to U.S. Pat. No. 6,616,881.

Nevertheless, that solution does not give full satisfaction.

OBJECTS AND SUMMARY OF THE INVENTION

An object of the present invention is to improve the situation.

To this end, the invention provides a fastener or closure assembly for fitting to a sheet or to the mouth of a packaging bag, and comprising at least one fastener or closure strip formed by a support web and a fastener or closure element carried by the web, the assembly including sequential cuts occupying a fraction of the width of the support web of the strip, outside the fastener or closure element and distributed over the length of the assembly in order to suppress the effects of warping, curving, or curling of the assembly.

The Applicant has found that making such cuts in fastener or closure assemblies through the support web outside the fastener or closure elements enables the above-mentioned warping, curving, or curling to be eliminated.

It would appear that the zone of cut implemented in this way in the assemblies allows stresses to relax, or at least makes it possible to prevent stresses from propagating, and consequently serves to eliminate the warping or the like that is to be found on assemblies as made in the prior art.

In a non-limiting embodiment in accordance with the present invention, the above-mentioned sequential cuts open out into one of the edges of each of the webs supporting said assemblies, i.e. into a narrow edge thereof. Nevertheless, in a variant, the sequential cuts can be made through an intermediate zone of each web supporting said assemblies, i.e. between the two side edges thereof, without opening out into said edges.

According to another advantageous characteristic of the present invention, the sequential cuts are made at the pitch of the bags. However, in a variant, the sequential cuts could be made at a pitch that is very different from that of the bags if the means for securing the assemblies on the films forming said bags make it possible to guarantee good contact between said assemblies and said films, including in the vicinity of the cuts.

The present invention also provides seats and bags obtained using fastener and closure assemblies as specified above.

BRIEF DESCRIPTION OF THE DRAWINGS

Other characteristics, objects and advantages of the present invention appear on reading the following detailed description made with reference to the accompanying drawings given as non-limiting examples, and in which.

MORE DETAILED DESCRIPTION

Figure 1:
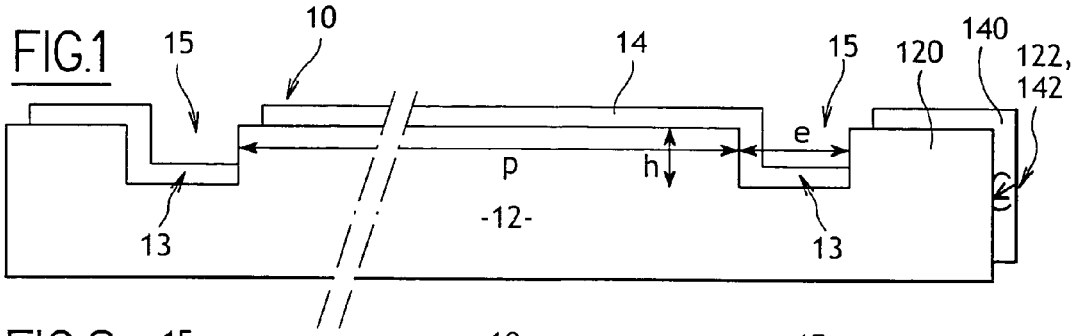
FIG. 1 is a diagram of a first cut configuration in accordance with the present invention.

Accompanying FIG. 1 shows a fastener or closure assembly 10 in accordance with the present invention suitable for fitting to the mouth of a packaging bag or to sheets, and constituted by two complementary strips 12, 14 provided with complementary male/female elements 122, 142, for example, or indeed with complementary hooks 124, 144 carried by support webs 120, 140.

As can be seen in accompanying FIG. 1, according to the invention the two strips 12 and 14 are provided with respective cuts 13, 15 in the webs 120, 140 outside the fastener elements 124, 144. These cuts 13, 15 may be formed at the same pitch p as the bags. In other words, the distance p between two cuts 13 and 15 and along the strips 12, 14, is equal in this example to the width of the mouths of the bags on which the strips are to be secured. However, in a variant, as mentioned above, the sequential cuts 13, 15 can be made at a pitch that is very different from the pitch of the bags, providing the means for securing the strips on the films forming said bags make it possible to guarantee good contact between said strips 12, 14 and said films, including in the vicinity of the cuts, i.e. if the securing means serve to avoid the strips 12, 14 becoming separated at these locations.

In the example shown in FIG. 1, the cuts 13, 15 are rectangular in outline. However, this disposition is not essential.

Figure 2:
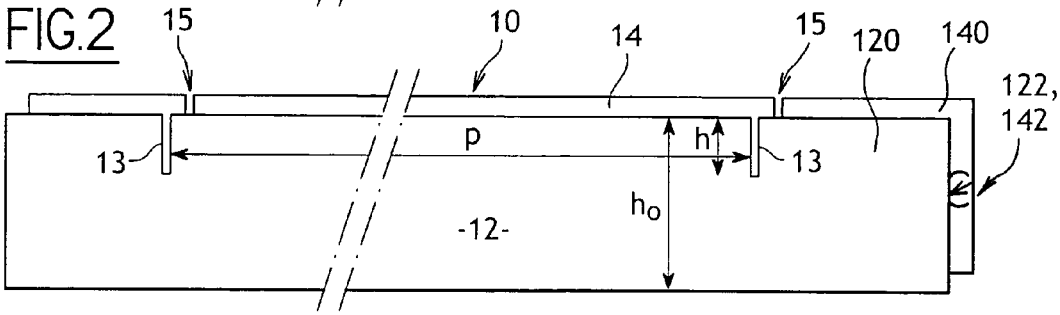
FIG. 2 shows a second cut configuration in accordance with the present invention.

Furthermore, in the configurations shown in FIGS. 1 and 2, the cuts 13, 15 all open out in the same edge of the strips 12, 14. The cuts extend between said edge and a zone adjacent to the fastener elements 124, 144, without extending below them.

Figure 8:
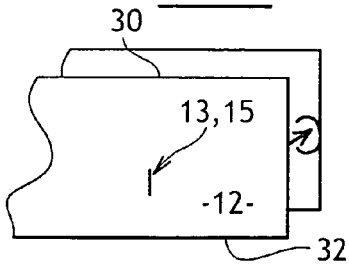
FIG. 8 shows a third cut configuration in accordance with the present invention.

Nevertheless, a variant configuration is shown in FIG. 8 in which the cuts 13, 15 are made in an intermediate zone of the webs of the strips, i.e. between the two side edges 30, 32 thereof, without opening out into either of these edges, and also without extending under the fastener elements 122, 142.

By way of non-limiting example, and in the context of the variant shown in FIG. 1, the cuts 13, 15 are of a width l greater than their height h.

Accompanying FIG. 2 shows a variant of a closure assembly in accordance with the present invention which differs from the first embodiment shown in FIG. 1 by the fact that the cuts 13, 15 form in the web 120, 140 are very narrow in width, and correspond to narrow notches that extend perpendicularly to the edges of the strips 12, 14. Where appropriate, the notches 13, 15 shown in FIG. 2 may be constituted merely by incisions, without any material being removed.

Figure 3:
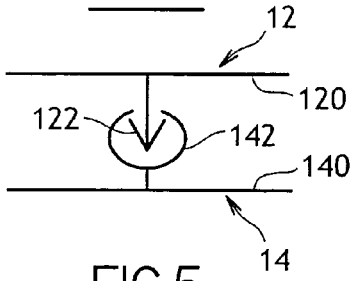
FIGS. 3 to 6 are diagrammatic section views of closure assemblies in accordance with four variant embodiments in accordance with the present invention.

Accompanying FIG. 3 shows an embodiment of prior art closure strips in which the strips 12, 14 comprise respective webs 120, 140 one of which carries a male element 122, while the other carries a complementary female element 142. Such closure strips are well known to the person skilled in the art and are shown here purely by way of illustration and are not described in greater detail below.

Figure 4:
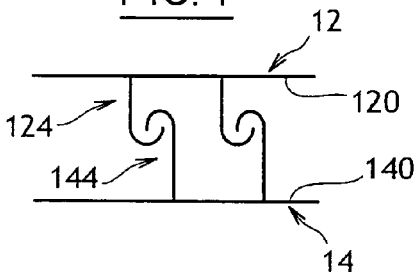

FIG. 4 shows another variant closure assembly in which the two strips 12, 14 comprise respective webs 120, 140 carrying complementary hook-type elements referenced 124, 144. In this example also, such a closure assembly is well known to the person skilled in the art, is given purely by way of illustration, and is not described in detail below.

Figure 5:
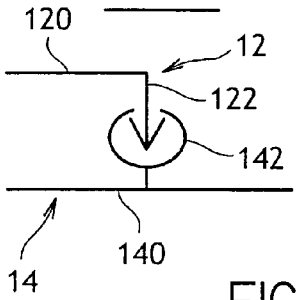
Figure 6:
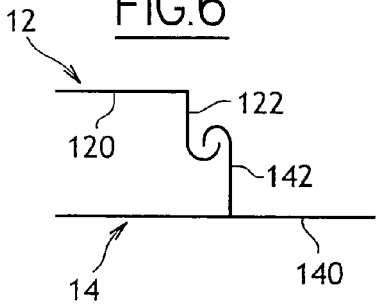

FIGS. 5 and 6 show two variant embodiments that are similar to FIGS. 3 and 4 respectively, in which one of the webs 120 extends to one side only of the closure elements 122, 124. Such a variant is also well known to the person skilled in the art and is therefore not described in detail below.

Figure 7:
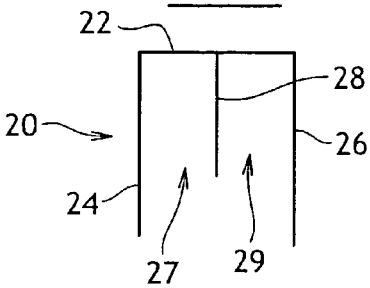
FIG. 7 is a diagrammatic section view of a slider suitable for fitting to closure assemblies in accordance with the present invention.

Finally, with reference to FIG. 7, there can be seen in cross-section the basic structure of a slider suitable for fitting to the above-mentioned closure assembly. The cursor 20 comprises a sole plate 22 carrying two side flanks 24, 26 and a central low wall 28. The low wall 28 and the side flanks 24, 26 defined between them two non-parallel channels 27, 29. The channels 27, 29 converge towards one axial end of the slider. The channels 27, 29 are designed for receiving respective ones of the strips 12, 14. The person skilled in the art will thus easily understand that when the slider 20 is moved towards one axial end of the closure strip it tends to separate them, and consequently to open the bag. In contrast, when the slider is moved towards the second end of the closure strips, then it tends to move them together and consequently to close the bag.

The closure strips 12, 14 in the present invention including the cuts 13, 15 and possibly also a slider 20 can be associated with any type of film suitable for making a packaging bag or sheets, particularly but not exclusively films made of plastics materials or of composite materials. Similarly, the fastener or closure strips 13, 15 can be secured to the strips by any suitable means, preferably by heating sealing.

In the context of the present invention, the height h of the cuts 13, 15 preferably lies in the range $1/3^{rd}$ to $1/10^{th}$ the height h0 of the closure strips 13, 15.

Naturally, the present invention is not limited to the particular embodiments described above, but extends to any variant coming within its spirit.

In the embodiments shown in FIGS. 1 to 8, the cuts 13, 15 extend perpendicularly to the edges 30, 32 of the closure strips.

Figure 9:
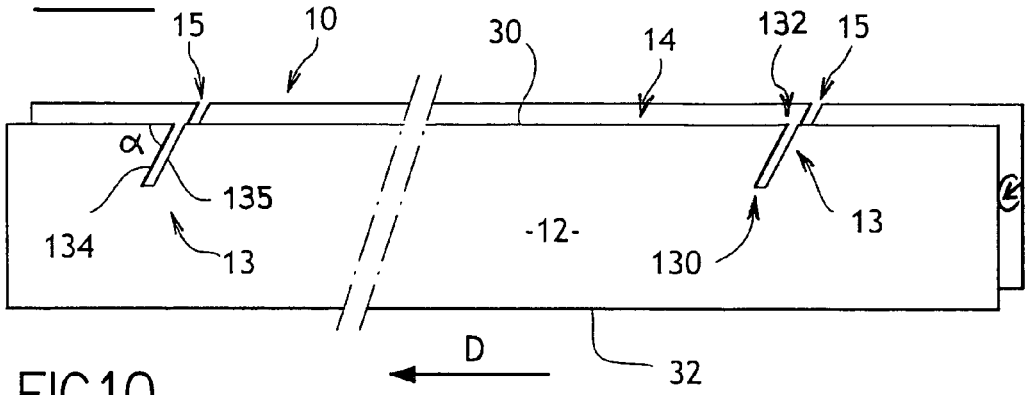
FIGS. 9 and 10 show two other variant cut configurations in accordance with the present invention.

FIG. 9 shows a variant configuration in which the cuts 13, 15 are oblique relative to the edges 30, 32.

More precisely, in FIG. 9, the cuts 13, 15 open out to one of the edges 30 of the closure strips. The oblique disposition of the cuts shown in FIG. 9 is also applicable to circumstances, as mentioned above, in which the cuts do not open out into either edge of the closure strips, but extend between the edges (as shown diagrammatically in FIG. 8).

Preferably, in the context of the present invention, the oblique cuts 13, 15 shown in FIG. 9 slope at an angle $\alpha$ of about 30° to 60° relative to the edges 30 of the strips.

Still more precisely, the closure strips shown in FIG. 9 are adapted to be moved in the direction shown by the arrow referenced D in FIG. 9 in such a manner that a guide or support that is stationary and relative to which the closure strips are moved, initially engages the ends 130 of the cuts 13, 15 situated towards the insides of the closure strips, and finally the free ends 132 of the cuts opening out in the edge 30. As a result, the closure strips do not present an acute leading edge but only obtuse angles placing the above-mentioned guide or support, thereby avoiding any risk of catching between the closure strips and the associated guides or supports.

The oblique disposition of the cuts shown in FIG. 9 is thus particularly advantageous when the closure strips are moved in a guide for fastening onto films that are for making the bag.

In the variant embodiment shown in FIG. 9, the cuts 13, 15 have parallel edges, where appropriate without any material being removed, as mentioned above.

Figure 10:
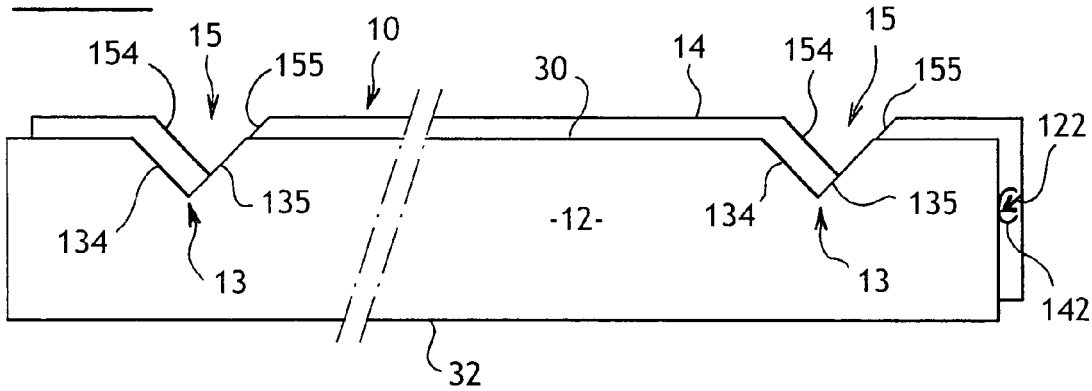

FIG. 10 shows a variant embodiment in which the cuts 13, 15 present edges 134, 135, 154, 155 that are not mutually parallel. The cuts 13, 15 thus form V-shapes with their open sides directed towards an opening in the edge 30 of a closure strip. FIG. 10 shows cuts 13, 15 that are symmetrical about a plane orthogonal to the edge 30. However this disposition is not essential, the cuts 13, 15 could be asymmetrical about such a plane orthogonal to the edge 30.

The cuts 13, 15 are defined by rectilinear edges 134, 135, 154, 155, each inclined at an angle lying in the range 30° to 60° relative to the edge 30 of the closure strips. This disposition presents the advantage whereby the closure strips can be moved in either direction relative to a stationary support or guide without any risk of catching.

Figure 11:
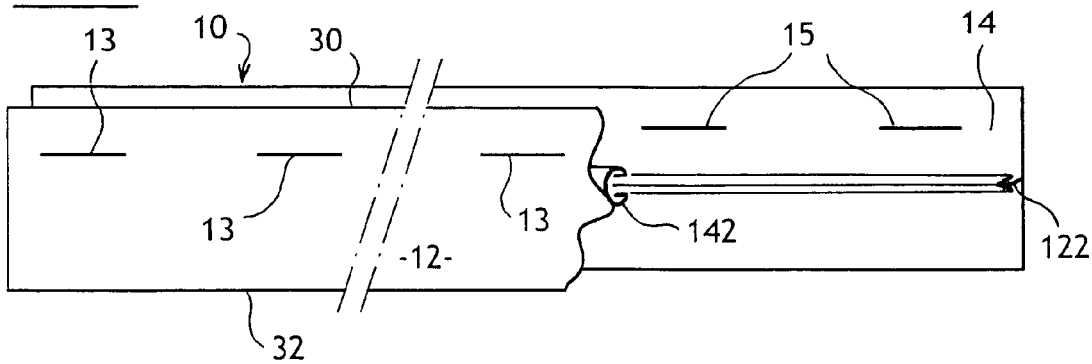
FIGS. 11 and 12 show two more variant cut configurations in accordance with the present invention.

FIG. 11 shows another variant configuration in which the cuts 13, 15 are generally parallel to the edges 30, 32. In FIG. 11 all of the cuts 13, 15 in the same strip are in alignment.

Figure 12:
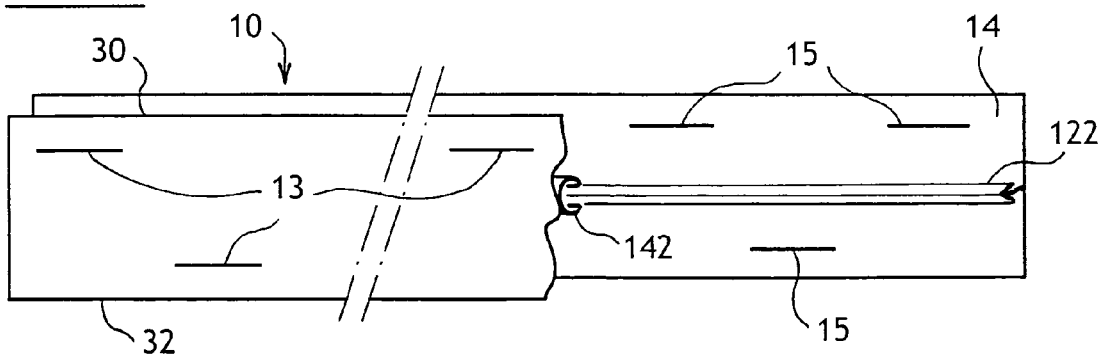

FIG. 12 shows another variant configuration in which the cuts 13, 15 while still being generally parallel to the edges 30, 32 of the strips, are not all in alignment.

What is claimed is:

1. A fastener or closure assembly for fitting to a sheet or to the mouth of a packaging bag, and comprising at least one fastener or closure strip formed by a support web and a fastener or closure element carried by the web, the assembly including sequential cuts occupying a fraction of the width of the support web of the strip, outside the fastener or closure element and distributed over the length of the assembly in order to suppress the effects of warping, curving, or curling of the assembly, wherein the cuts are formed by respective incisions, without any material being removed.

2. An assembly according to claim 1, comprising two complementary fastener or closure strips, at least one of which includes the sequential cuts.

3. An assembly according to claim 2, wherein each of the two complementary fastener or closure strips includes sequential cuts in its respective web outside the fastener or closure elements.

4. An assembly according to claim 1, wherein all of the cuts open out to a common edge of the strips.

5. An assembly according to claim 1, wherein all of the cuts are made between the two edges of each strip.

6. An assembly according to claim 5, wherein the cuts generally extend parallel to the edges of the strips.

7. An assembly according to claim 6, wherein the cuts made in a single strip are all in alignment.

8. An assembly according to claim 6, wherein the cuts made in a single strip are not all in alignment.

9. An assembly according to claim 1, wherein the cuts extend transversely to the edges of the strips.

10. An assembly according to claim 1, wherein the cuts are oblique relative to the edges of the strips.

11. An assembly according to claim 10, wherein the cuts are inclined at an angle lying in the range 30.degree. to 60.degree. relative to the edges of the strips.

12. An assembly according to claim 10, wherein edges of the cuts are inclined at an angle lying in the range 30° to 60° relative to the edges of the strips.

13. An assembly according to claim 1, wherein the height of the cuts lies in the range $1/3^{rd}$ to $1/10^{th}$ the height h0 of the strips.

14. An assembly according to claim 1, wherein the cuts are made at the pitch of the bags.

15. An assembly according to claim 1, wherein the cuts are made at a pitch different from that of the bags.

16. An assembly according to claim 1, the assembly being made of polyolefins, preferably of polyethylene or polypropylene.

17. An assembly according to claim 1, comprising two strips having complementary male/female elements.

18. An assembly according to claim 1, comprising two strips fitted with complementary hooks.

19. An assembly according to claim 1, including an actuator slider.

20. A bag fitted with a fastener assembly comprising at least one fastener or closure strip formed by a support web and a fastener or closure element carried by the web, the assembly including sequential cuts occupying a fraction of the width of the support web of the strip, outside the fastener or closure element and distributed over the length of the assembly in order to suppress the effects of warping, curving, or curling of the assembly, wherein the cuts are formed by respective incisions, without any material being removed.

21. A sheet fitted with a fastener assembly comprising at least one fastener or closure strip formed by a support web and a fastener or closure element carried by the web, the assembly including sequential cuts occupying a fraction of the width of the support web of the strip, outside the fastener or closure element and distributed over the length of the assembly in order to suppress the effects of warping, curving, or curling of the assembly, wherein the cuts are formed by respective incisions, without any material being removed.

22. A fastener or closure assembly for fitting to a sheet or to the mouth of a packaging bag, and comprising at least one fastener or closure strip formed by a support web and a fastener or closure element carried by the web, the assembly including sequential cuts occupying a fraction of the width of the support web of the strip, outside the fastener or closure element and distributed over the length of the assembly in order to suppress the effects of warping, curving, or curling of the assembly, wherein the cuts generally extend parallel to the edges of the strips, and the cuts made in a single strip are not all in alignment.

23. An assembly according to claim 22, comprising two complementary fastener or closure strips, at least one of which includes the sequential cuts.

24. An assembly according to claim 22, wherein the cuts are formed by respective incisions, without any material being removed.

25. An assembly according to claim 22, including an actuator slider.

26. An assembly according to claim 22, the assembly being made of polyolefins, preferably of polyethylene or polypropylene.

27. A bag fitted with a fastener assembly comprising at least one fastener or closure strip formed by a support web and a fastener or closure element carried by the web, the assembly including sequential cuts occupying a fraction of the width of the support web of the strip, outside the fastener or closure element and distributed over the length of the assembly in order to suppress the effects of warping, curving, or curling of the assembly, wherein the cuts generally extend parallel to the edges of the strips, and the cuts made in a single strip are not all in alignment.

28. A fastener or closure assembly for fitting to a sheet or to the mouth of a packaging bag, and comprising at least one fastener or closure strip formed by a support web and a fastener or closure element carried by the web, the assembly including sequential cuts occupying a fraction of the width of the support web of the strip, outside the fastener or closure element and distributed over the length of the assembly in order to suppress the effects of warping, curving, or curling of the assembly, wherein the cuts are made at the pitch of the bags, wherein all of the cuts are made between the two edges of each strip.

29. An assembly according to claim 28, wherein the cuts generally extend parallel to the edges of the strips.

30. An assembly according to claim 29, wherein the cuts made in a single strip are all in alignment.

31. An assembly according to claim 29, wherein the cuts made in a single strip are not all in alignment.

32. An assembly according to claim 28, comprising two complementary fastener or closure strips, at least one of which includes the sequential cuts.

33. An assembly according to claim 28, wherein all of the cuts open out to a common edge of the strips.

34. A fastener or closure assembly for fitting to a sheet or to the mouth of a packaging bag, and comprising at least one fastener or closure strip formed by a support web and a fastener or closure element carried by the web, the assembly including sequential cuts occupying a fraction of the width of the support web of the strip, outside the fastener or closure element and distributed over the length of the assembly in order to suppress the effects of warping, curving, or curling of the assembly, wherein the cuts are made at the pitch of the bags, wherein the cuts are oblique relative to the edges of the strips.

35. An assembly according to claim 34, wherein the cuts are inclined at an angle lying in the range 30° to 60° relative to the edges of the strips.

36. An assembly according to claim 34, wherein edges of the cuts are inclined at an angle lying in the range 30° to 60° relative to the edges of the strips.

37. A fastener or closure assembly for fitting to a sheet or to the mouth of a packaging bag, and comprising at least one fastener or closure strip formed by a support web and a fastener or closure element carried by the web, the assembly including sequential cuts occupying a fraction of the width of the support web of the strip, outside the fastener or closure element and distributed over the length of the assembly in order to suppress the effects of warping, curving, or curling of the assembly, wherein the cuts are made at the pitch of the bags, wherein the cuts have edges that are not parallel.

38. A fastener or closure assembly for fitting to a sheet or to the mouth of a packaging bag, and comprising at least one fastener or closure strip formed by a support web and a fastener or closure element carried by the web, the assembly including sequential cuts occupying a fraction of the width of the support web of the strip, outside the fastener or closure element and distributed over the length of the assembly in order to suppress the effects of warping, curving, or curling of the assembly, wherein the cuts are made at the pitch of the bags, wherein the cuts form V-shapes.

39. An assembly according to claim 38, wherein the cuts are symmetrical about a plane perpendicular to the edges of the strips.

40. An assembly according to claim 38, wherein the cuts are asymmetrical about a plane orthogonal to the edges of the strips.

41. A fastener or closure assembly for fitting to a sheet or to the mouth of a packaging bag, and comprising at least one fastener or closure strip formed by a support web and a fastener or closure element carried by the web, the assembly including sequential cuts occupying a fraction of the width of the support web of the strip, outside the fastener or closure element and distributed over the length of the assembly in order to suppress the effects of warping, curving, or curling of the assembly, wherein the cuts are made at the pitch of the bags, wherein the cuts are formed by respective incisions, without any material being removed.

42. A fastener or closure assembly for fitting to a sheet or to the mouth of a packaging bag, and comprising at least one fastener or closure strip formed by a support web and a fastener or closure element carried by the web, the assembly including sequential cuts occupying a fraction of the width of the support web of the strip, outside the fastener or closure element and distributed over the length of the assembly in order to suppress the effects of warping, curving, or curling of the assembly, wherein the cuts are made at the pitch of the bags, wherein the height of the cuts lies in the range $\frac{1}{3}$"[1] to $\frac{1}{10}^{th}$ the height hO of the strips.

* * * * *